US010646764B1

(12) United States Patent
Hobbs

(10) Patent No.: US 10,646,764 B1
(45) Date of Patent: May 12, 2020

(54) THROWING TRAINER AND METHOD

(71) Applicant: 224 Performance, LLC, Raleigh, NC (US)

(72) Inventor: Johnston Hobbs, Raleigh, NC (US)

(73) Assignee: 224 Performance, LLC, Raleigh, NC (US)

( * ) Notice: Subject to any disclaimer, the term of this patent is extended or adjusted under 35 U.S.C. 154(b) by 0 days.

(21) Appl. No.: 16/278,137

(22) Filed: Feb. 17, 2019

(51) Int. Cl.
*A63B 69/00* (2006.01)

(52) U.S. Cl.
CPC ..... *A63B 69/0059* (2013.01); *A63B 69/0002* (2013.01); *A63B 2069/0006* (2013.01)

(58) Field of Classification Search
CPC ..... A63B 69/3608; A63B 69/0059; A63B 2017/0655; A63B 69/3641; A63B 2102/18; A63B 69/0002; A63B 69/0071; A63B 69/38; A63B 2069/0006; A63B 2071/0694; A63B 2102/32; A63B 2243/0025; A63B 69/002; A63B 2102/02; A63B 21/4005; A63B 21/4007; A63B 21/4009
USPC ..... 473/212, 215, 216, 422, 438, 450, 458, 473/464
See application file for complete search history.

(56) References Cited

U.S. PATENT DOCUMENTS

| | | | | |
|---|---|---|---|---|
| 4,383,685 | A * | 5/1983 | Bishop | A63B 69/0071 473/450 |
| 4,519,608 | A * | 5/1985 | Gilly | A63B 69/38 473/215 |
| 5,390,929 | A * | 2/1995 | Todaro | A63B 69/0059 473/215 |
| 6,932,724 | B2 * | 8/2005 | Socci | A63B 69/0002 473/422 |
| 7,686,699 | B2 * | 3/2010 | Snyders | A63B 69/0059 473/215 |
| 8,157,665 | B2 * | 4/2012 | Gibbs | A63B 69/3641 473/215 |
| 8,740,730 | B1 * | 6/2014 | Przyborowski | A63B 69/0059 473/438 |
| 9,956,467 | B2 * | 5/2018 | Vehslage | A63B 69/3608 |
| 2011/0201438 | A1 * | 8/2011 | Butts | A63B 69/3608 473/215 |
| 2016/0082337 | A1 * | 3/2016 | Guerrero | A63B 71/0622 473/458 |

* cited by examiner

*Primary Examiner* — Nini F Legesse
(74) *Attorney, Agent, or Firm* — NK Patent Law

(57) ABSTRACT

This invention is an apparatus and method of training an athlete to properly throw a ball utilizing proper arm and elbow position by providing a device that attaches to the athlete's waist and has a semi-rigid guide rod extending up from the waist toward the shoulders such that it is positioned to contact the athlete's arm or elbow during the throwing motion once the arm or elbow is moved back into the ideal position, thus providing a tactile signal when the ideal position is reached thereby allowing the athlete to continually train and develop muscle memory of the proper throwing position.

8 Claims, 4 Drawing Sheets

THROWING TRAINER AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

Sports and sporting events are extremely popular around the world. Athletes and other participants in sporting events are always trying to improve their skills, thus improving their performance in the sport. Many of the most popular sports include games that require throwing a ball. These would include such sports as baseball and football. Further, these sports and others require an athlete to throw a ball powerfully and accurately. Athletes are continually trying to improve their ability to throw a ball powerfully and accurately. A need therefore exists for devices and methods to assist athletes in developing their ability to properly throw a ball.

The ability to throw a ball powerfully and accurately is extremely important to performance and to avoid injury to the athlete. As an athlete increases the torque on his arm before the throw, the increasing forces must be managed to prevent injury. While a high torque will result in a powerful throw, an athlete must have his arm in the proper position to maximize power and accuracy and avoid injury. Most of the power in an athlete's throw comes not from the arm, but from the torso and upper legs. The torso and upper legs contribute to providing the forces necessary to deliver a powerful and accurate throw.

It is important to appreciate that the power with which an athlete throws a ball can lead to injury if the arm is not in the proper position for throwing a ball. Throwing a ball requires use of the arm muscles in combination with the muscles of the torso and legs. It is important that the arm is in the proper position for throwing so that the larger, more powerful muscles of the torso and legs do not injure the arm by exerting force against the arm when it is in an improper position. The bones and musculature system of the arm needs to be protected while at the same time allowing the athlete to maximize the power and accuracy of throwing.

Thus, there exists a need for a device that can train athletes to keep the arm in proper position for throwing a ball.

DESCRIPTION OF RELATED ART INCLUDING INFORMATION DISCLOSED UNDER 37 CFR 1.97 AND 1.98

While there are many training devices that purport to train an athlete on the proper way to throw a ball, none meet the needs fulfilled by the present invention. Particularly, many of the training devices currently available are as adaptable to various athletes or are as portable.

One such prior art device is that taught in US 2014/0287852 to Clark. This device is a training apparatus to help train athletes to properly throw a ball. The '852 application works by guiding body parts pertinent to the throwing motion and includes a rigid rod member that presses against the players back, providing a restrictive mechanical barrier that restricts incorrect throwing motions. The '852 device also has a flexible guide member extending from the rod member, terminating at a ball. The guide member creates a predetermined quantity of tension that counteracts a centrifugal force generated from the throwing motion. In this manner, when the player simulates a throw, the mechanism of the throw is better controlled for teaching and observation purposes. A ball attaches to the end of the guide member for the player to grasp and simulate an appropriate throwing motion against tension from the guide member. The rod member presses against the player's back to provide additional resistance and guide appropriate body positioning during the simulated throw. Importantly, unlike Applicant's invention, the '852 device has a rod member that is substantially linear and rigid, configured to press against the player's back in a substantially vertical or a substantially horizontal orientation. Unlike Applicant's device, the '852 device cannot be manipulated into different positions as desired by the athlete dependent on the particular method of throwing in which the athlete is training. Thus, there exists a need for a device that has the advantages of Applicant's invention.

The current prior art falls short of the desired characteristics of the present invention. None of the prior art provides a simple, effective, portable apparatus for training an athlete to properly throw a ball. Further, the prior art does not address the need for a training apparatus that can be easily configured for multiple athletes and can be continually used by an athlete as his skill level increases. Applicant's invention solves all of these shortcomings of the prior art.

Thus, it is an object of the present invention to provide an apparatus for training an athlete to properly throw a ball that includes a base unit with a guide rod connected to the base unit. The guide rod is made so it is extending outward from the base unit and is also adaptable to extend upwardly toward the athlete's shoulders.

It is a further object of the present invention to provide an apparatus with a clip attached to the base unit so that the base unit can clip or otherwise attach to an athlete's belt or clothing. This allows the invention to be easily moved from athlete to athlete when multiple athletes are being trained. The base unit can also be integral to a guide rod such that the base unit and guide rod could be manufactured to be a single unit. Thus, the attachment portion of the guide rod would attach to the athlete's belt or clothing.

It is a still further object of the present invention to have a guide rod that is of sufficient length to extend upwardly toward the athlete's shoulders and be contacted by the athlete's arm or elbow during the throwing motion. Thus, the guide rod needs to be long enough to be able to fit athletes of different heights and different physical attributes. The guide rod needs to be made of a semi-rigid material or otherwise made so it is capable of being manipulated into a specific position and configuration. It must be able to remain in the position so that it will remain in such position and configuration throughout the throwing motion.

It is another object of the invention to provide an apparatus for training an athlete to utilize the proper arm and elbow position from which to throw an object that would include a clamp unit capable of attaching to an athlete. There is also a support unit adapted to attach to the clamp unit that has a cylindrical tube extending outwardly from the support unit. The cylindrical tube is made to accept a guide rod. The guide rod is manufactured to attach to the support unit in a conventional matter. The guide rod extends outwardly and upwardly from the support unit and is of sufficient length to contact an athlete's arm or elbow during a throwing motion.

It is also an object of the present invention to provide a method of training an athlete to properly throw a ball. This method includes the steps of affixing a training apparatus to the athlete's body that includes a guide rod. Then the guide rod of the training apparatus is configured to extend upwardly toward the athlete's shoulders. The guide rod is positioned into the correct position in relation to the athlete's shoulders so that when the athlete's arm moves into throwing position, the athlete's arm or elbow will contact the guide rod at the optimal position for throwing.

It is a still further object of the present invention to provide a method for training to properly throw a ball when the athlete is currently using an improper throw and is moving the arm or elbow too far behind the shoulders for a proper throw. This method has steps including selecting an initial position of the guide rod such that the rod contacts the arm or elbow at a point further back that the ideal throwing position. This will allow an athlete to contact the guide rod behind the ideal position where the athlete is used to moving the arm or elbow. The athlete will need to unlearn the muscle memory of the incorrect position by repeating the training gradually moving the arm and elbow into the proper position. The method includes the athlete performing the throwing motion such that the arm or elbow contacts the guide rod in a position further behind the ideal position. The athlete keeps repeating the throwing motion and periodically moving the guide rod forward toward the proper position as the athlete's arm begins to move toward the optimal position. Over time and repeating training, the athlete can keep adjusting the guide rod forward until it places the arm or elbow in the proper position for throwing. By repeating the throwing motion while moving the guide rod forward, the athlete develops muscle memory of how far back to move the throwing arm before it contacts the guide rod, and thus learns the proper distance back to move the arm and elbow. Once the athlete has developed muscle memory of where the ideal throwing position is, the athlete continues by removing the apparatus. At the conclusion of the training, the athlete has developed sufficient muscle memory that the athlete's arm and elbow are continually in the proper throwing position.

BRIEF SUMMARY OF THE INVENTION

Applicant's invention is directed to a new and novel apparatus and method to improve an athlete's ability to throw a ball. More particularly, Applicant's invention is directed to an apparatus and method that facilitates training an athlete in the proper stance and position while throwing a ball. Applicant's invention is directed to an apparatus that attaches to the body and extends upwardly toward the athletes arm. The invention provides a tactile indication when the athlete's arm begins to move out of the proper position for throwing a ball. Further, the Applicant's invention is adjustable such that it can be used on different athletes and can be adjusted to continually train an athlete as the athlete's skill level improves.

Applicant's invention is also directed to a method of training an athlete in which a specific apparatus is used to train the athlete on proper positioning of the arm to achieve the maximum speed, accuracy, and power for throwing a ball while at the same time reducing the potential for injury from the arm being in an improper throwing position. Applicant's method involves using an apparatus to indicate to the athlete the maximum movement of the arm behind the shoulder that is proper to achieve the ideal throw.

Applicant's invention can consist of two primary parts. The first is a base unit that is configured to attach to an athlete's clothing or belt, primarily envisioned to be used and secured near the athlete's waist. The base unit is configured to have a means by which it can be secured to the athlete so it will not come off during the athlete's training. Thus, the base unit needs to be designed such that it can be affixed to the athlete yet removed when it is desired to switch the device to another athlete or shift position on the current athlete. It is contemplated that the base unit can be made to have a clip extending off the back of the base unit such that the clip will fasten around a belt or the waistband of the athlete's pants. This clip can be any of a number of types of clips including a clamping device, a ring or hook configured to fit around a belt, or another conventional way to attach to the belt or clothing.

Opposite to the clip portion, the base unit is configured to hold a guide rod that can be affixed either permanently or removably to the base unit. The guide rod can be configured to attach to the base unit in any of a number of ways, each of which is contemplated by the present invention. The guide rod extends from the base unit and is of sufficient length to extend upwardly from the athlete's waist toward the athlete's shoulders such that the athlete's arm will contact the guide rod during a throw. As can be readily appreciated by those skilled in the art, the base unit and guide rod could be one in the same, if the guide rod was configured to attach directly onto the athlete's belt or clothing.

In a preferred embodiment, Applicant's invented apparatus consists of three main parts. The first part of Applicant's invention consists of a clamp unit that is a spring-loaded or static clip that affixes to an athlete belt, pants, shirt or other clothing worn by the athlete at or near the hip. The clamp unit affixes to the belt or clothing at a certain location and is designed such that it will not move from the position at which it is placed during the athlete's training. The clamp unit is further designed such that it can be readily detached from the belt and moved to locations either toward the belly or toward the back of the athlete in order to facilitate training and placement of the arm during throwing. It should be appreciated by those skilled in the art that the clamp unit can be any of a number of standard type clips with either spring loaded or friction pads designed to secure the clamp unit in a fixed position on the belt or other clothing. Further, is should be appreciated that the clamp unit can be readily detached from one athlete and attached to another athlete simply by removing the clamp unit from the athlete's belt.

The second part of Applicant's invented apparatus is a support unit designed to attach to the clamp unit and support a guide arm extending from upwardly from the support unit. The support unit is able to securely attached to the clamp unit which attaches to the athlete's belt. The support unit contains a raised cylindrical tube in which a guide arm is placed. It is contemplated that the cylindrical tube would contain one or more screws, pins, or other fastening device to secure the end of a guide rod into the support unit such that it is securely fastened and will not fall out during an athlete's training. It is still further contemplated that the support unit could be configured to support and accept different diameter guide rods and easily switch from one guide rod to another, depending on the desired training, such that any of a number of different guide rods could be securely fastened to the clamp unit. It is further contemplated that the support unit and the clamp unit could be manufactured of a type of rigid plastic and could be dyed various colors to represent a specific team, sponsor, training company, or other entity using the invented apparatus. The support unit could also be manufactured such that it is integral to the guide rod thus eliminating any attachment points and any potential for loosening or weakening of the guide rod attachment point.

The third piece of Applicant's invention consists of a guide rod that is placed in and secured to the support unit. It is contemplated that the guide rod would be made of a semi-flexible material such that it will allow a user to bend the guide rod into specific angles, but would maintain the angle when attached to the support unit. Thus, the guide rod should be manufactured to maintain a degree of rigidity in the position in which the athlete has bent the guide rod. It is further contemplated that the guide rod could be manufactured of a plastic, metal, or other material such that its rigidity would be sufficient to maintain it in an upright position and fixed angle set by the athlete or trainer. It is further contemplated that the guide rod is manufactured such that an athlete could cover the guide rod with cloth, leather, or other material such that it would not be abrasive when rubbing against the athlete's back or arm, or could be decorated with team colors or logos.

The guide rod is constructed of sufficient length to extend from the support unit attached to the athlete's waistline vertically toward the athlete's shoulder. The guide extends from the waist line in the direction of the athlete's shoulder, specifically the right shoulder for athletes who throw with their right arm, and toward the left shoulder for athletes who throw with their left arm. The guide rod extends upwardly and outwardly from the waist forming one half of a V-shape with the athlete's back. At the opposite end from where the guide rod attaches to the support unit, it is contemplated that the guide rod will have a cap, knob, or other end piece to protect the end of the rod from scratching the athlete or otherwise damaging the athlete's clothing or arm. It is further, contemplated that in certain cases an athlete may desire to use a rigid guide rod instead of a flexible guide rod. Depending on the desired training and particular sport for which the athlete is training, the athlete may desire to have an inflexible guide rod inserted into the support unit instead of a flexible guide rod. It is further contemplated that the guide rod could be of variable length depending on the applications and use desired by the athlete.

In order to train an athlete in the proper manner in which to throw a ball, Applicant's invention is used in conjunction with repetitive throwing by the athlete. The athlete will attach Applicant's invention to his or her belt and position the guide rod such that it will extend upwardly and outwardly, away from the athlete's shoulder. For purposes of this description, it is assumed that the athlete is a right-handed person. Once the apparatus is attached to the athlete's belt and the guide rod extended upwardly and outwardly from the athlete's back, a trainer or the athlete himself will align the guide rod such that the end of the guide rod is in the plane created by the athlete's shoulder blades. The athlete then raises his arm into the proper position at which to begin a throw of a ball. Proper position of the athlete's arm is verified by a trainer of the athlete and the guide rod is moved until it makes contact with the athlete's arm. When the guide rod is adjusted to contact the athlete's arm, it is set into this position and is in the proper position to begin training the athlete. At this point, the athlete is ready to begin his training session.

In order to train to properly throw the ball with proper positioning of the arm, the athlete begins the motion of throwing a ball. The athlete will begin the throw by lifting his arm and bringing his elbow back toward his shoulder into the proper position to throw the ball. When the athlete's arm reaches the ideal position from which to throw the ball, the arm will not have contacted the guide rod. If the athlete continues to move the elbow or arm further back and out of the ideal position, the athlete's arm will contact the guide rod. The athlete will receive a tactile signal that his arm is touching the guide rod alerting him that his arm or elbow is too far back. The guide rod of Applicant's invention thus alerts the athlete that his arm is deviating from the perfect position from which to throw the ball and the athlete can stop his arm's rearward movement. It should be noted that it is contemplated that the guide rod is flexible enough such that if the athlete pulls his arm back to throw the ball too far, his arm will contact the guide rod and push it slightly backward. This will allow an athlete who is used to bringing his arm too far back to begin to train himself to stop rearward movement of his arm at the proper position. The guide rod is flexible such that the athlete will not injure himself by bringing his arm back too far and contacting the guide rod.

It can be readily understood by those skilled in the art that Applicant's apparatus is designed to mimic the effects of the exercise and training used by athletes where they train to throw a ball by standing against a wall. Specifically, it is a common exercise for an athlete to stand with his back against a wall and practice lifting his arm to throw a ball. The wall acts as a barrier preventing the athlete's arm from reaching too far behind the athletes shoulder. Because the wall is rigid and cannot be moved, the athlete's arm will raise but will not backup any further than parallel alignment with the plane formed by the athlete's shoulder blades. By aligning the athlete's elbow in a parallel line with the athlete's shoulder blades, the exercise ensures that the muscle and bones of the athlete's arm are properly aligned to achieve the maximum power and accuracy of the throw. Further, this specific alignment between the athlete's elbow and shoulder blades protects against injuries that could be caused by over rotation or overextension of the arm behind the shoulders. Thus Applicant's invention achieves the same result of properly training an athlete to keep his elbow in alignment with his shoulders and preventing the elbow from extending behind the plane created by the athlete's shoulder blades. In addition to the benefits of the standard wall training, Applicant's invention allows the athlete to slowly train in achieving the proper position for the throwing arm. Further, unlike using a wall for this training, an athlete can use Applicant's apparatus anywhere as the apparatus is small, lightweight, and portable.

BRIEF DESCRIPTION OF THE SEVERAL VIEWS OF THE DRAWING(S)

DETAILED DESCRIPTION OF THE INVENTION

Figure 1:
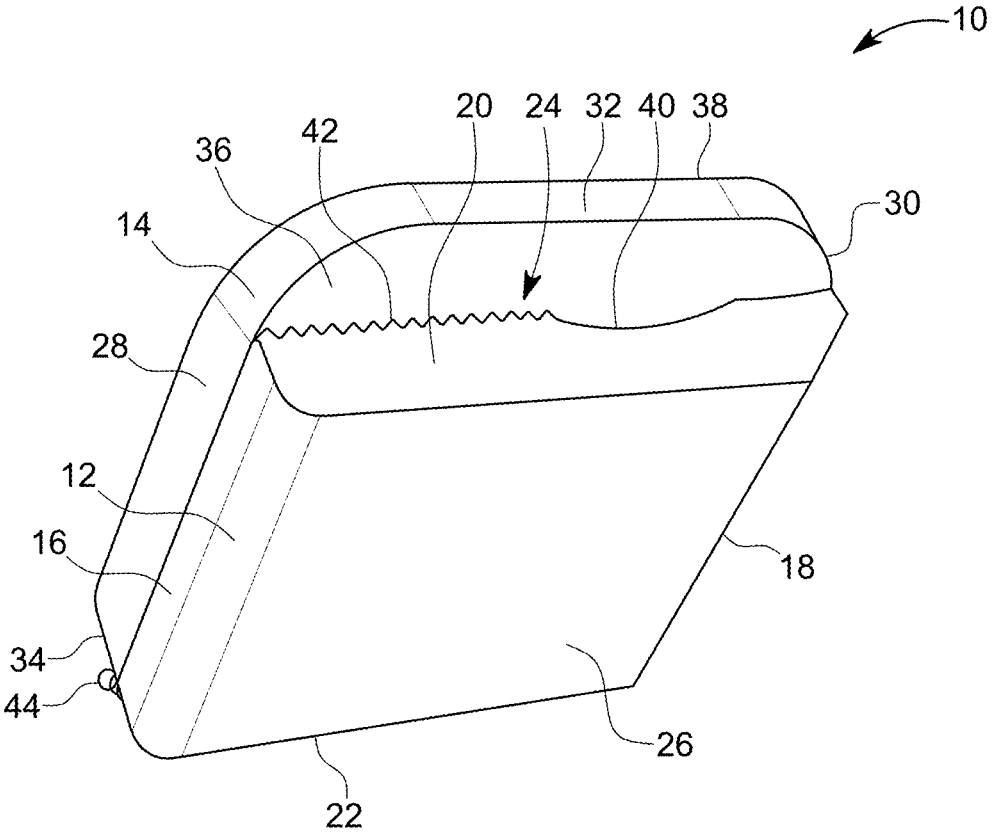
FIG. 1 is a perspective view of the clamp unit portion of Applicant's invention.

Referring now to FIG. 1 which is a perspective view of the clamp unit 10 of Applicant's invention. The clamp unit 10 is comprised of a clamp top 12 and a clamp bottom 14 rotatably attached together such that the clamp top 12 and clamp bottom 14 can form a clamping device to secure to a belt, shirt, or other item of clothing not shown. The clamp top 12 portion is comprised of a top right edge, 16 a top left edge 18 opposite from and parallel to the top right edge 16 separated by a top front edge 20 and a top back edge 22. The top front edge 20 and the top back edge 22 are opposite and parallel to each other such that the shape of the clamp top 12 is generally rectangular. The clamp top 12 further consists of a top inner surface 26 and a top outer surface which define the area between the top right edge 16 top left edge 18 top front edge 20 and top back edge 22 The top inner surface is 24 intended to exert pressure against belt, piece of clothing, or other material upon which the clamp unit 10 is placed.

The clamp bottom 14 comprises a bottom right edge 28 a bottom left edge 30 a bottom front edge 32 and a bottom back edge 31 defining an area between said edges consisting of a bottom inner surface 36 and a bottom outer surface 38 The bottom inner surface 36 is intended to exert pressure against a belt, piece of clothing, or other item upon which the clamp unit 10 is exerting pressure and is designed to oppose the pressure exerted by the clamp top. 12

The clamp top 12 further consists of an indentation 40 in the top inner surface 24 designed to accommodate a user's finger and facilitate opening the clamp unit 10 during use. The top inner surface 24 in a preferred embodiment, has teeth 42 designed to securely grip a belt, piece of clothing, or other item upon which the clamp unit 10 is affixed. In a preferred embodiment, the clamp top 12 is fixed to the clamp bottom 14 by means of a spring 44 The spring 44 is attached to the top back edge 22 of the clamp top and the bottom back edge 34 of the clamp bottom 14 such that the spring 44 exerts force on the top back edge 22 and the bottom back edge 34 to create the clamping force necessary to attach the clamp unit 10 to a belt or piece of clothing upon which the clamp unit 10 is placed. It should be recognized by those skilled in the art that other means of adjoining the clamp top 12 to the clamp bottom 14 is possible, and references to a spring 44 are not meant to be limiting, but rather as a description of the preferred embodiment of Applicant's invention.

Figure 2:
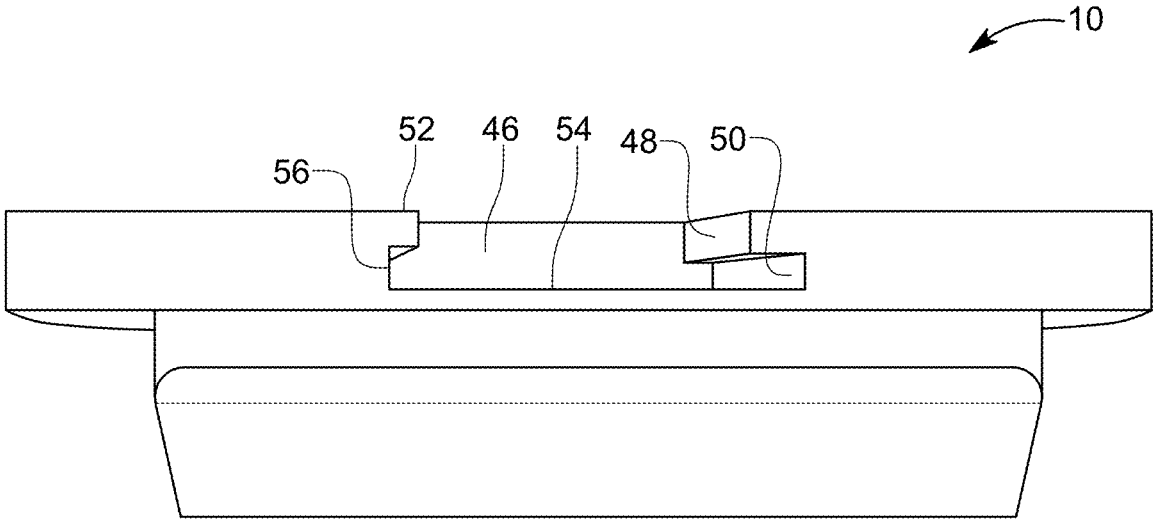
FIG. 2 is a front view of the clamp unit portion of Applicant's invention.

Referring now to FIG. 2 which is a front view of the clamp unit 10 showing the clamp bottom 14 with a cavity 46. The clamp bottom 14 is manufactured to contain a cavity 46 designed to accept an accompanying protrusion, similar to male/female clips and other conventional means of attachment. The cavity 46 is formed in the bottom outer surface of 38 the clamp bottom 14 and defined by a first side 48 a second side 50 and a third side which combine to form an open area on the bottom outer surface. The first side is configured to meet the second side at approximately a 90° angle, and the second side 50 is configured to meet the third side 52 at approximately a 90° angle such that the first side 48 and the third side 52 are substantially parallel to each other and form the cavity 46 in the bottom outer surface. 38 The first side 48 is further configured to define a first side channel 50 running between the first side 48 and the cavity bottom 54 and the third side 52 is configured to have a third side channel 56 such that the third side channel 56 is substantially parallel to the first side channel. 50 It should be appreciated that the first side 48 second side 50 and third side 52 define the cavity 46 and cavity bottom 54 in the bottom outer surface 38 of the clamp bottom 14. The cavity 46 in the bottom outer surface 38 has only three sides and is open on one side such that a corresponding protrusion 48 may be inserted and securely held by the cavity 46 in the clamp bottom. 14

Figure 3:
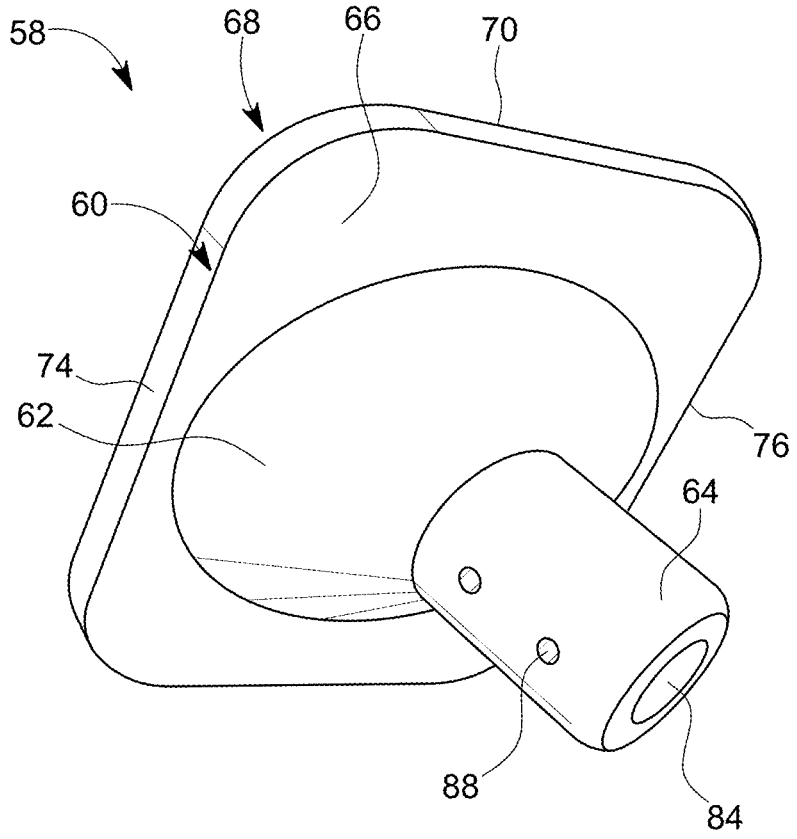
FIG. 3 is a rear view of the support unit portion of Applicant's invention.
Figure 4:
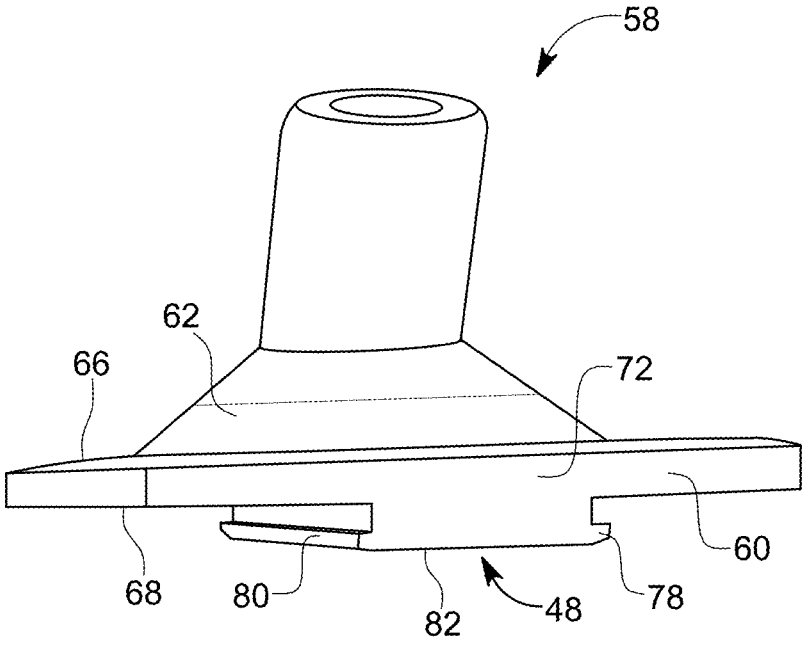
FIG. 4 is a perspective view of the support unit portion of Applicant's invention.

Referring now to FIG. 3 and FIG. 4 which are a rear view of the support unit and a perspective view of the support unit portion of Applicant's invention showing the support unit 58 of Applicant's invention. The support unit 58 consists of a base 60 cone 62 and cylindrical tube 64. The base 60 is made up of the base top 66 base bottom 68 base front 70 base back 72 base right edge 74 and base left edge 76 all of which combine to form a generally rectangular base 60 of the support unit. 58 The base bottom 68 is manufactured to include a protrusion 48 extending from the base bottom 68 outwardly away from the base top 66 The protrusion 48 is generally configured in a rectangular shape and has a right lip 78 and a left lip 80 on opposite sides extending over and parallel to the base bottom. 68 Both the right lip 78 and left lip 80 are designed to be substantially the correct size for insertion into the clamp bottom 14 into the cavity 46 wherein the right lip 78 corresponds in size to the first side channel 50 and the left lip 80 corresponds in size to the third side channel. 56 Thus, when the protrusion 48 is slidingly engaged into the cavity 46 it is retained by the frictional forces exerted by the right lip 78 and left lip 80 engaging the first side channel 50 and the third side channel 56 Further, the protrusion top 82 is pressed firmly against the cavity bottom 54 such that it is maintained in position by frictional forces.

The support unit 58 is further configured to have a cone 62 extending outwardly from the base top 66 such that the larger end of the cone abuts the base top 66 and extends upwardly as it narrows forming the shape of a cone. The cone 62 is configured with a cylindrical tube 64 extending off of the top end of the cone. 62 The cylindrical tube 64 extends upwardly from the cone 62 and defines an opening at 84 the end opposite from the base 60 such that a guide rod 86 may be inserted into the opening. 84 The cylindrical tube 64 extending from the cone 62 is further constructed to contain hole 88 through which a screw not shown, pin not shown or other retention device will engage with the guide rod 86 securing it in the cylindrical tube 64 and thereby attaching it to the support unit 58 It should be appreciated by those skilled in the art that the cylindrical tube 64 need not have a secure fastener, and that it could be manufactured to be integral to a guide rod 86 thereby eliminating the need for additional attachment pieces. It is contemplated that the support unit 58 can be removed from the clamp unit 10 by pulling in an upward direction, and separately the protrusion 48 from the cavity 46. Further, it is contemplated that the support unit 58 can be securely affixed to the clamp unit 10 by inserting the protrusion 48 into the cavity 46 such that the right lip 78 and left lip 80 engage the first side channel 50 and the third side channel 56 to secure the support unit 58 to the clamp unit 10.

Figure 5:
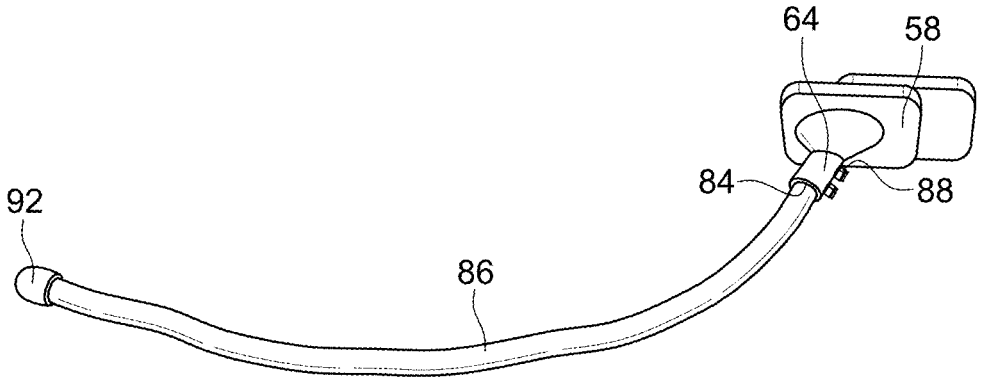
FIG. 5 is a side view of a preferred embodiment of Applicant's invention.

Referring now to FIG. 5 which is a side view of a preferred embodiment of Applicant's invention, one can see the third piece of Applicant's invention that consists of a guide rod 86 designed such that it will slidingly engage through the opening 84 in the cylindrical tube 64 and thus be attached to the support unit 58 and extend outwardly therefrom. In a preferred embodiment, the guide rod 86 is composed of a semi rigid plastic or other material allowing the guide rod 86 to be bent into a desired configuration yet retain enough rigidity to maintain its configuration once it is bent in the desired manner. The guide rod 86 can be of any length desired by the user, however it must be of sufficient length to extend upwardly from the support unit 58 to at least a sufficient height to allow the athlete to engage the guide rod 86 with his arm or elbow. Further the guide rod 86 is designed to be extended outwardly from the support unit 58 such that it forms a V-shape with the athlete's back. The guide rod 86 is configured with a tip 90 on the end opposite from the support unit 58 wherein such tip 90 is adapted to receive a cap 92 or other coating to prevent injury or damage to an athlete's clothing. It should further be noted that the guide rod 86 can be adapted to receive coatings, a covering, or other adaptations to prevent chafing or rubbing against either the athlete or the athlete's clothing during use.

Figure 6:
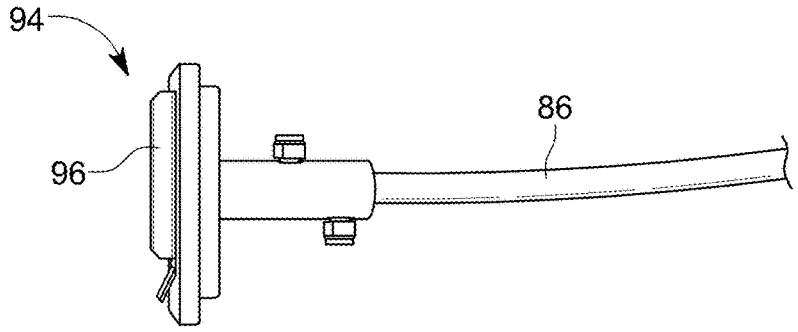
FIG. 6 is a side view of the base unit and end of the guide rod of Applicant's invention.
Figure 7:
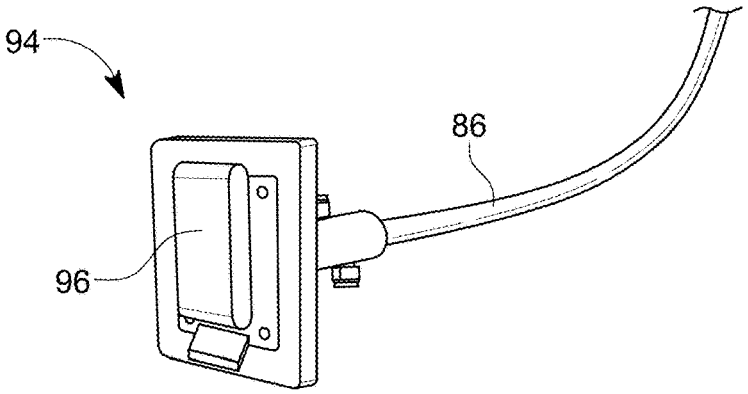
FIG. 7 is a rear perspective view of the base unit and guide rod of Applicant's invention.
Figure 8:
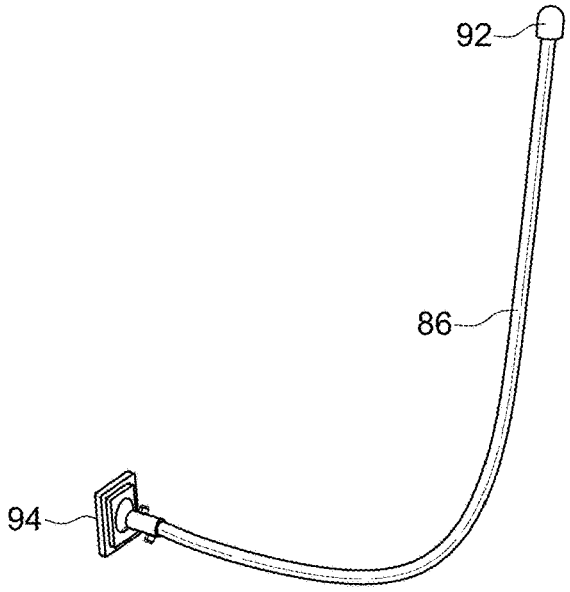
FIG. 8 is a perspective view of Applicant's invention.

Referring now to FIG. 6, FIG. 7, and FIG. 8, another embodiment of Applicant's invention is shown. In these figures, a base unit 94 is shown configured to receive a guide rod 86. The base unit 94 is configured with a clip 96 adapted to secured to an athlete's belt or clothing.

Operation and detailed description of the training method.

Applicant's invention includes a method for training an athlete to properly throw a ball. The method includes an athlete attaching the clamp unit 10 to his belt and attaching the support unit 58 and guide rod 86 to the clamp unit 10 The athlete adjusts the guide rod to extend in the proper direction behind athlete such that when the athlete lifts his arm to throw ball, the guide rod 86 will contact the athlete's arm at the point at which the arm is parallel to the plane defined by the athlete's shoulders. Once the guide rod 86 is set in this position, the athlete proceeds to practice throwing the ball. During the athlete's practice, if the athlete extends his arm too far behind his shoulders, his arm will contact the guide rod 86 and present the athlete with a tactile signal that his arm is too far back and in an improper position. By repeating the throwing exercise, the athlete will soon learn how far back he can extend his arm before contacting the guide rod 86 After repeated use, the athlete will develop a muscle memory indicating the proper position at which his arm must stop extending backwards. Thus, as the athlete improves his throwing position, his arm will cease contacting the guide rod 86 when he brings it back to begin the throw. At this point, the athlete has achieved a proper position for throwing a ball. Repeated practice by the athlete of the throwing motion by placing his arm into the proper position will establish a muscle memory by which the athlete will be able to repeatedly make properly aligned throws keeping his elbow and arm in the proper position in relation to his shoulder blades.

It is further contemplated that the method of training an athlete to throw a ball using Applicant's device can be used to continually improve the position of the athlete's arm relative to the athlete's shoulders. With a beginning athlete or an athlete who has substantial difficulty keeping his arm in the proper position, the guide rod 86 is flexible such that it can be bent into a specific position that is too far behind the athlete's shoulder plane. As the athlete gradually improves, the guide rod 86 can be slowly adjusted forward to continually shrink the distance between the proper throwing position and the improper position. Thus, as the athlete's skill and form of throwing improves, and the athlete's elbow position continually moves forward toward the plane formed by the athlete's shoulders, the guide rod 86 can be continually repositioned to gradually improve the athlete's throw. Thus, Applicant's invention is adaptable for use with a novice athlete and a professional athlete. As such, Applicant's invention and method can be used with athletes of all ages and ability levels and can be adapted to use continually to improve an athlete's throwing. Further it is contemplated that a trainer, coach, or other instructional person may adjust the guide rod 86 during practice or a training session to assist the athlete to avoid developing a bad habit or relying on an improper position of the athlete's arm or elbow. It should be appreciated by those skilled in the art that while the aforementioned method is a preferred embodiment of Applicant's method of training, there can be many variations all of which are contemplated to be included in this recitation. None of the recited and discussed limitations in the foregoing description shall be limiting, but shall be read to encompass all variants of Applicant's invention which are covered by the following claims.

The invention claimed is:

1. An assembly for pitch training, comprising:

a garment engaging clip;

a mount extending from the clip and selectively engageable therewith, wherein a gap is defined between the clip and the mount for receiving a belt or waist band worn around a waist of a pitcher; and a support bar extending from the mount and selectively positionable such that a height of an end of the support bar can be adjusted, and an angle of the support bar relative to the mount can be adjusted, wherein, in use, the end of the support bar is adjusted such that an arm of the pitcher abuts an end of the support bar during motion.

2. The assembly of claim 1, wherein the mount is selectively engaged with the garment engaging clip.

3. The assembly of claim 1, wherein the support bar is rotatably pivoted within the mount in order to adjust the height of the support bar.

4. The assembly of claim 1, wherein the support bar defines a rod with a cap that defines an enlarged circumference compared to the rod, the cap defining an arcuate upper surface.

5. A method for pitch training, the method comprising:

attaching a belt engaging clip with a garment positioned about a waist of a pitcher, wherein the belt engaging clip is engaged about a belt or waist band on a hand dominant side of the pitcher;

extending a support bar from a mount that is engaged with the garment engaging clip, wherein the support bar is selectively positionable such that a height of an end of the support bar can be adjusted, and an angle of the support bar relative to the mount can be adjusted;

initiating a pitching motion where the pitcher throws the ball;

adjusting a height of the support bar such that an arm of the pitcher clears an end of the support bar during the pitching motion.

6. The method of claim 5, wherein the mount is selectively engaged with the garment engaging clip.

7. The method of claim 5, wherein the support bar is rotatably pivoted within the mount in order to adjust the height of the support bar.

8. The method of claim 1, wherein the support bar defines a rod with a cap that defines an enlarged circumference compared to the rod, the cap defining an arcuate upper surface.

* * * * *